US006857864B2

(12) United States Patent
Kettner

(10) Patent No.: US 6,857,864 B2
(45) Date of Patent: Feb. 22, 2005

(54) REVERSIBLE AIR MOTOR HAVING THREE DRIVE CHAMBERS

(75) Inventor: Konrad Karl Kettner, Aalen (DE)

(73) Assignee: Cooper Power Tools GmbH & Co., Westhausen (DE)

( * ) Notice: Subject to any disclaimer, the term of this patent is extended or adjusted under 35 U.S.C. 154(b) by 0 days.

(21) Appl. No.: 10/268,589

(22) Filed: Oct. 10, 2002

(65) Prior Publication Data

US 2004/0071579 A1 Apr. 15, 2004

Related U.S. Application Data

(63) Continuation of application No. PCT/EP01/04205, filed on Apr. 11, 2001.

(30) Foreign Application Priority Data

Apr. 11, 2000 (DE) ..... 200 06 683

(51) Int. Cl.[7] ..... F01C 1/344; F01C 21/12
(52) U.S. Cl. ..... 418/266; 418/270
(58) Field of Search ..... 418/258, 268, 418/270, 266

(56) References Cited

U.S. PATENT DOCUMENTS

| | | | | |
|---|---|---|---|---|
| 2,452,471 A | | 10/1948 | Jones | |
| 2,575,524 A | * | 11/1951 | Mitchell | 418/270 |
| 3,230,840 A | * | 1/1966 | Hanson | 418/184 |
| 3,498,186 A | * | 3/1970 | Northcutt | 418/152 |
| 3,614,276 A | | 10/1971 | Erdmann | 418/266 |
| 3,858,559 A | * | 1/1975 | Thomas, Jr. | 418/258 |
| 4,822,264 A | * | 4/1989 | Kettner | 418/270 |

FOREIGN PATENT DOCUMENTS

| | | | |
|---|---|---|---|
| DE | 2125516 | 12/1972 | |
| EP | 0 052 162 | 5/1982 | |
| FR | 1512886 | 1/1968 | |
| FR | 2 762 879 | 4/1997 | |
| GB | 732394 | 6/1955 | |
| RU | 632830 | * 11/1978 | 418/270 |

* cited by examiner

*Primary Examiner*—John J. Vrablik
(74) *Attorney, Agent, or Firm*—Coats & Bennett, P.L.L.C.

(57) ABSTRACT

An air motor, especially for a screwer, comprises an air rotor which is rotatably supported in a motor cylinder and comprises a plurality of longitudinal slits extending in the longitudinal direction of the rotor for radially guiding lamellae, the air rotor and motor cylinder having formed thereinbetween chambers which can be brought into communication with an air inlet and/or an air outlet. To achieve a high efficiency of the motor together with a more uniform accelerating power, a reduced sound level and less wear while the exhaust air throttling measures are reduced at the same time, the motor cylinder comprises an inner chamber of an essentially triangular cross-section, one chamber each being formed between air rotor and a triangle tip.

33 Claims, 3 Drawing Sheets

REVERSIBLE AIR MOTOR HAVING THREE DRIVE CHAMBERS

This application is a continuation of PCT Application No. PCT/EP01/04205, filed 11 Apr. 2001, which is incorporated herein by reference; this application also claims priority from German Patent Application No. 200 06 683.8, filed on 11 Apr. 2000, which is also incorporated her in by reference.

FIELD OF THE INVENTION

The present invention relates to an air motor, especially for a screw driving device.

BACKGROUND OF THE INVENTION

An air motor which is installed in a screw driving device ("screwer") is known in practice. The screwer has a compressed air connection for supplying compressed air to the air inlet of the air motor. The compressed air passes through the air inlet into one of the chambers between motor cylinder and air rotor and acts on one of the lamellae. The air rotor is thereby rotated. A further chamber will then communicate with the air inlet while the chamber already acted upon by compressed air releases the compressed air again via a corresponding air outlet to the environment. Due to the alternating filling and emptying of the chambers with compressed air, and since the lamellae radially protruding outwards from the air rotor are subjected to compressed air, the air rotor and the output shaft connected thereto are rotated on the whole. As a consequence, a corresponding screwing tool is rotated for screwing or unscrewing a screw, or the like.

The known air motor comprises two chambers opposite each other relative to the air rotor. Such an air motor has a relatively high idling speed and overall performance. The power or rotational speed of such an air motor must be reduced in part by exhaust air throttling measures.

EP 052162 shows a rotating piston machine with sliding slides for operation with expanding gases, said rotating piston machine. In said rotating piston machine, pressure from gases is directly converted into a rotating movement; the pressure is here to act always exactly in tangential direction relative to the rotary movement. A cover plate has arranged therein openings through which gas enters or exits. The openings are arranged at ends of a drum for permitting the tangential supply of the gases.

FR 2762879 shows a compressor with a cylindrical rotary body as the rotor. In the rotor, a plurality of lamellae are adjustably supported in corresponding grooves, the lamellae being inclined relative to the radial direction. In corresponding chambers, a fluid is compressed upon rotation of the rotor and discharged to the outside via outlets.

In the light of EP052162, it is the object of the present invention to improve an air motor of the above-mentioned type in such a way that together with a high efficiency of the motor a more uniform accelerating power, a reduced sound level and less wear are possible together with a reduction of the exhaust air throttling measures.

SUMMARY OF THE INVENTION

The three-chamber air motor according to the invention yields a lower motor speed and, at the same time, a more uniform accelerating power because of the three chambers. With the same constructional size as in a two-chamber motor, this yields an increase in torque and also a reduced sound level because of a reduced speed. Due to the lower motor speed during screwing, troublesome supply-air and exhaust-air throttling measures are no longer required, in particular in screwers of the non-switching-off type. At the same time, an oil-free running is more likely due to the lower speed than in the known single-chamber and two-chamber motors. The construction is further simplified in that on outsides of each triangle side at least one air inlet channel and air outlet channel extend in neighboring relationship with each other in the longitudinal direction of the air rotor. It is thus not necessary to form, e.g., corresponding channels in the housing or to provide air inlet or outlet only at ends of the housing.

The rotational direction of the air rotor is selected in that the rear and/or front rotor cover are rotatable for the alternative supply of air inlet or outlet channel with air relative to the motor cylinder. For instance, the corresponding holes in the rotor cover can be communicated, on the one hand, with the air inlet channels, e.g., for rotations in clockwise direction, or with the air outlet channels to rotate e.g., the air rotor anticlockwise. It is decided through the corresponding assignment of the hole in the rotor cover which ones of said channels serve as air inlet or air outlet.

To be able to discharge the air from the chambers via the rotor cover, corresponding air outlets may be formed in the front and/or rear rotor cover, said air outlets being connected to air inlet or air outlet channel, depending on the assignment of the corresponding air inlets in the rotor cover. The air outlets are designed as outlet recesses which are open at least towards the rotor cylinder. At least the corresponding air outlet channel communicates with such a recess for the fast discharge of air. Since the outlet recesses extend in partly annular-shaped fashion, the expanded compressed air is already discharged in the area of the corresponding chambers. Such an arrangement of the outlet recesses yields a better expansion ratio than in known air motors and, at the same time, an enhanced performance without the constructional size of the air motor being enlarged.

To allow a self-centering of the air rotor in a simple way, the inner chamber of the motor cylinder is advantageously provided with the cross-section of an isosceles triangle, the rotational axis of the air rotor being in particular arranged at the point of intersection of the three mid-perpendiculars of the corresponding triangle sides.

To support the air rotor here in an even better centered way, the triangle sides of the motor cylinder may be convexly curved at least in the area of the respective mid-perpendicular. The curvature is substantially identical with the curvature of the air rotor.

To be able to guide—upon rotation of the air rotor—the lamellae in a simple way along an inner surface of the motor cylinder with the free ends thereof, such an inner surface of the motor cylinder may be convexly curved preferably at least in the area of the triangle tips. The free ends of the lamellae thereby slide without any difficulty along the inner surface, in particular also in the area of the triangle tips.

For a simplified manufacture of the motor cylinder and to permit a movement of the air rotor that is as uniform as possible, the inner surface of the motor cylinder may comprise identical radii of curvature in the area of the triangle tips.

A simple manufacture for air inlet and air outlet channel is possible if e.g., both channels are formed in a channel body of the motor cylinder.

To accommodate the air motor of the invention in an easy way in a corresponding screwer without any dimensional overdefinition, the outer diameter of the motor cylinder should be located on such a circular line that the whole motor cylinder can be inserted into a screwer with an accommodating means of a correspondingly larger diameter.

In this context, it must further be considered as an advantage when the diameter of the circular line is also substantially smaller than a diameter of a front and/or rear rotor cover. Said rotor covers close the chambers at front and rear ends positioned in the longitudinal direction of the air rotor and simultaneously serve to support a shaft made mostly integral with the air rotor.

An advantageous manufacture of the air motor is possible in that the channel bodies extend between the front and rear rotor covers over the whole length of the motor cylinder.

Air may be supplied to the air inlets, for instance, from a radial direction relative to the motor cylinder. The air may here be supplied between e.g., a rotor cover and the motor cylinder. In a simple embodiment, the rear rotor cover may comprise at least air inlets for the supply of air to the air inlet channels.

To supply air in the longitudinal direction of motor cylinder and air rotor, respectively, such an air inlet may be designed as a hole passing through the rotor cover.

The cross section of hole and/or air inlet channel may have different shapes. In the simplest case such a cross section may be circular.

For discharging air from the corresponding chambers, in particular in radial direction, the outlet recess may be opened radially outwards via an outlet gap.

To be able to discharge air to the outside not only via the outlet channel, but also at least in part directly from the corresponding chamber, the outlet recess may extend—if connected to an outlet channel at one of its ends—with its other end into an area between triangle tip and channel body.

The outlet recess can thereby communicate with one of the chambers arranged downstream of the associated outlet channel in the rotational direction of the air rotor—also for the discharge of air into the environment.

The outlet recess is here sufficiently large if an inner radius of the outlet recess is substantially equal to an outer radius of the air rotor.

To be able to rapidly supply and discharge, respectively, a sufficient amount of air in the area of air inlet channel and air outlet channel, air inlet channel and air outlet channel may be provided on the inside of the motor cylinder with slits which extend over part of the respective length thereof and are open towards the air rotor and are separated by a sealing web with which the air rotor is in tight contact.

The air rotor may e.g., comprise four corresponding longitudinal slits and lamellae arranged therein. However, for a uniform acceleration of the air rotor more lamellae and a corresponding number of longitudinal slits are desired, e.g., five, six, seven, eight or more longitudinal slits with corresponding lamellae. For a uniform running of the air motor without a corresponding unbalance, it is further of advantage when the longitudinal slits with the corresponding lamellae are equally spaced apart in circumferential direction.

To safely subdivide the chambers by the lamellae into a partial chamber to be filled with air and into a partial chamber to be evacuated, a mid-point angle assigned to the length of the outlet recess in circumferential direction may be greater than an angle between two neighboring lamellae.

To act on the lamellae in a simple way in radial direction to the outside with a force, use is preferably made of even numbers of longitudinal slits and lamellae, a respective pressure spring being possibly arranged between two diametrically opposed lamellae.

To subject the lamellae at their radially inner ends with compressed air, in addition or as an alternative to the pressure springs, the rear rotor cover may comprise compressed air recesses which are arranged about a central hole and extend concentrically relative to the central hole. Depending on the position of the rear rotor cover relative to the motor cylinder, compressed air is supplied through the compressed air recesses to the longitudinal slits in the air rotor especially in those areas in which the corresponding lamellae in the area of the chambers are pushed out of the air rotor.

To supply the lamellae with compressed air in a uniform way and in the area of the chambers, the compressed air recesses may be equally spaced apart from one another in the circumferential direction of the central hole and/or opened laterally relative to the central hole. Via the lateral opening relative to the central hole, compressed air can easily be supplied via the central hole to the compressed air recesses.

To supply compressed air, depending on the orientation of the air inlets in the rear rotor cover, for the right-hand or left-hand rotation of the air rotor, an air distributing means may be arranged for the supply of compressed air to the air inlets of the rear rotor cover at the side thereof that is opposite to the air rotor.

In a simple embodiment, the air distributing means may be disk-shaped and comprise three air distributing grooves extending from a central air supply hole radially to the outside, i.e. at the side oriented towards the rear rotor cover.

In accordance with the shape of the air rotor, the air distributing grooves may be arranged in circumferential direction at an equal distance from one another and assigned to a group of air inlets for compressed air actuation, depending on the relative position with respect to the rear rotor cover.

Instead of a deaerating of the chambers via the air outlets radially to the outside relative to the rear rotor cover, the air outlets may pass through the rear rotor cover for deaerating the chambers in axial direction, in particular when the air motor according to the invention is used in substantially straight tools, in angle screwers, or the like.

To be able to switch in an easy way between left-hand and right-hand rotation of the air motor, the rear rotor cover may be lockably supported in two positions relative to the motor cylinder for the left-hand and right-hand rotation of the air rotor. It should here be noted that of course instead of a rotation of the rear rotor cover relative to the motor cylinder it is also possible to rotate the front rotor cover and motor cylinder relative to a rear rotor cover which is arranged in a rotationally fixed manner and to switch between left-hand and right-hand rotation of the air rotor in this way.

In the two aforementioned cases, an adjustment is possible in that a switching knob protrudes radially outwards from the rear rotor cover or from the front rotor cover or from the motor cylinder. It is also possible that the locking operation for fixing the two positions for the left-hand and right-hand rotation of the air rotor takes place by means of the switching knob.

To accommodate rear and front rotor cover as well as motor cylinder with air rotor in an easy way, the air motor may comprise a motor housing which may comprise an air supply channel communicating with the air supply hole, as well as a rotor hole supporting the output shaft of the air rotor.

To receive the reaction force of the motor cylinder, a pin may be arranged between front rotor cover and motor cylinder. The reaction moment of the front rotor cover may e.g., be transmitted by a cotter pin, or the like, to the motor housing.

It should be noted in connection with the air rotor that said rotor in its axial position is defined by the two rotor covers whereas the radial position is solely defined by the air rotor, with a sufficient clearance remaining between motor cylinder and motor housing in that the corresponding diameter of the motor cylinder is smaller than that of the rotor cover.

BRIEF DESCRIPTION OF THE DRAWINGS

An advantageous embodiment of the present invention shall now be explained in the following in more detail with reference to the figures attached to the drawing, in which.

DETAILED DESCRIPTION OF THE INVENTION

Figure 1:
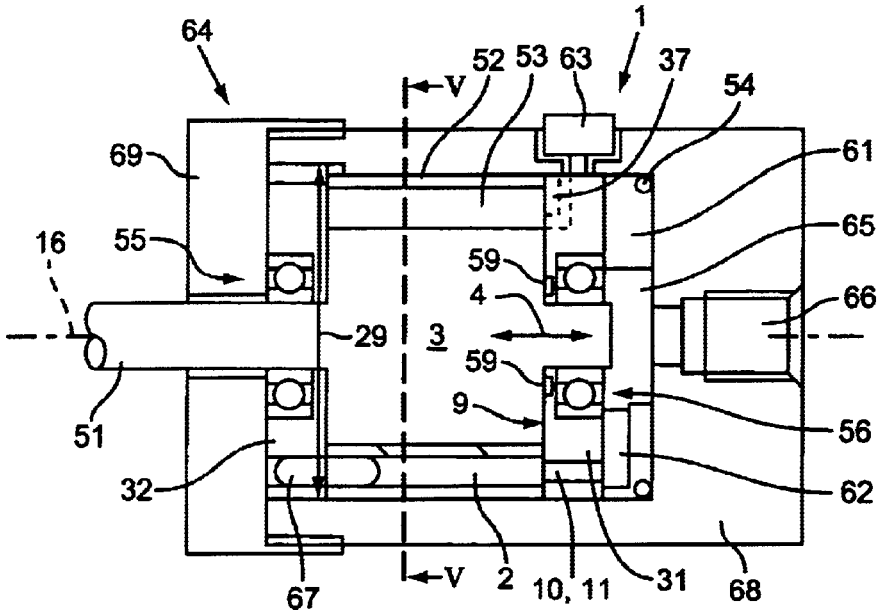
FIG. 1 is a longitudinal section through an air motor according to the invention.

FIG. 1 shows a longitudinal section through an air motor 1 according to the invention. Said motor comprises an output shaft 51 which extends in concentric fashion relative to a rotational axis 16 and is made integral with an air rotor 3; see FIG. 5. The air motor 1 is provided in the area of the output shaft 51 with a rear rotor cover 31 and with a front rotor cover 32 spaced apart therefrom in the direction of rotational axis 16. A motor cylinder 2 is arranged between the two rotor covers. A disk-shaped air distributing means 61 is arranged next to the rear rotor cover 31. At an end 9 opposite the air distributing means 61, the rear rotor cover 31 comprises outlet gaps 37 which are outwardly open in radial direction. Said gaps are arranged between the rear rotor cover 31 and the motor cylinder 2.

Motor cylinder 2 and rear and front rotor covers 31, 32 have a substantially circular cross-section.

Motor cylinder 2 comprises side flanks 52, 53 extending in the longitudinal direction 4 of said motor cylinder and in the longitudinal direction of air motor 1, respectively (see also FIG. 5), the flanks extending obliquely radially inwards. The side flanks 52, 53 separate channel bodies 26 and triangle tips 13, 14, 15; see also FIG. 6. The triangle tips 13, 14, 15 form the corresponding tips of an inner chamber of the motor cylinder 2 having a substantially triangular cross-section.

Figure 5:
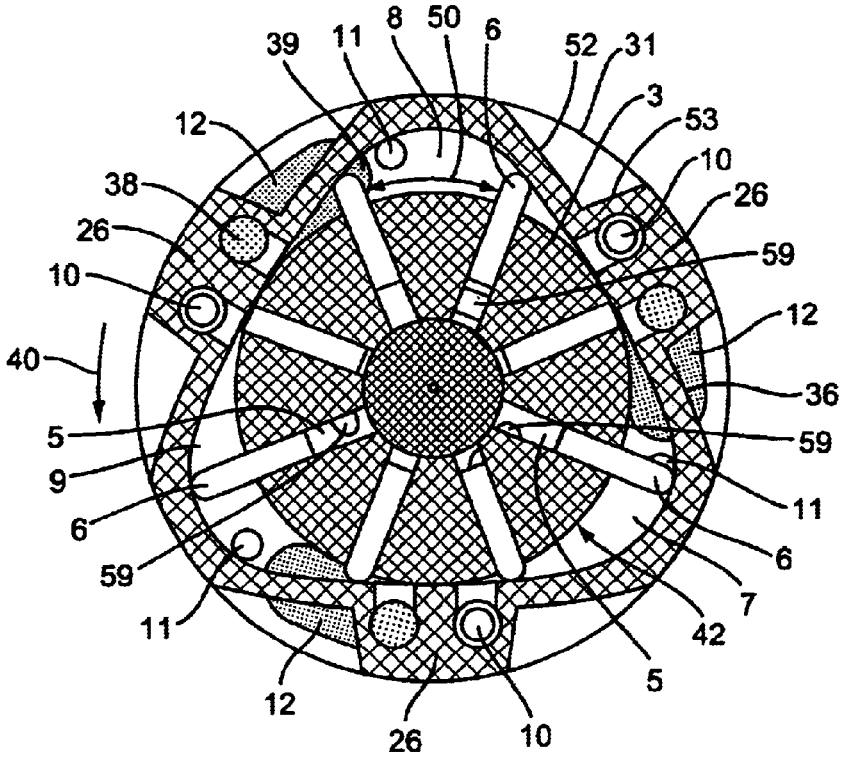
FIG. 5 is a section through FIG. 1 along line V—V for left-hand rotation.
Figure 6:
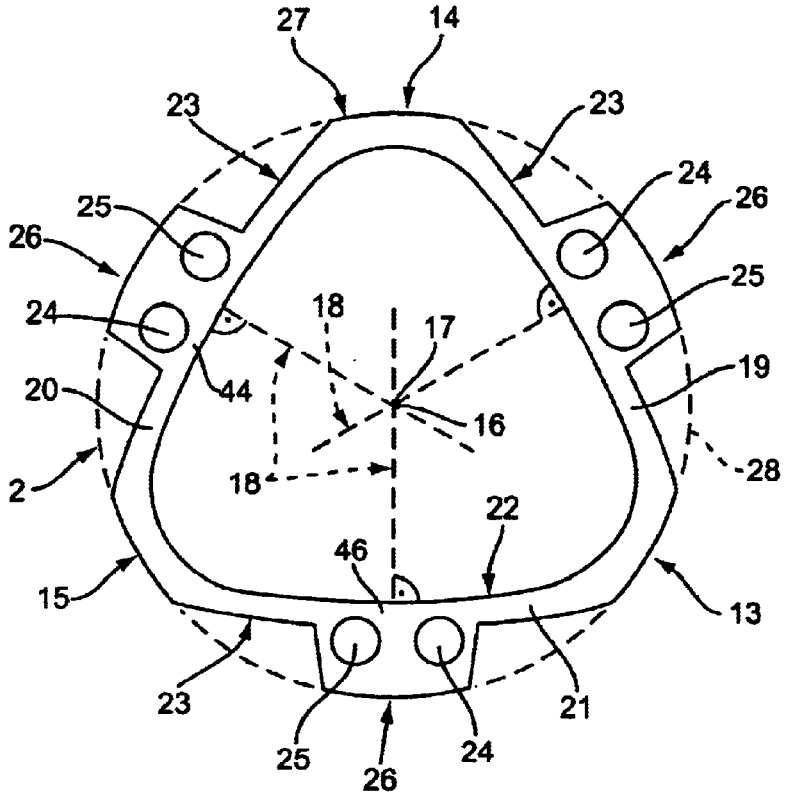
FIG. 6 is a section according to FIG. 5 through a motor cylinder.

The substantially circular cross-section of the motor cylinder 2 follows from channel bodies 26 protruding from corresponding triangle sides 19, 20, 21 (see FIGS. 5 and 6) on the outsides 23 thereof, both the triangle tips 13, 14, 15 and the channel bodies 26 being rounded on their outer surfaces and extending along a circular line 28 (see FIG. 6). Said circular line 28 has a diameter slightly smaller than the diameter 29 according to FIG. 1.

In FIG. 1, the front rotor cover 32 is in tight contact with the front end of the motor cylinder 2.

An air distributing means 61 is arranged opposite the motor cylinder 2 laterally next to the rear rotor cover 31. The air distributing means comprises an air supply hole 65 approximately in the center. A stub projecting from the air rotor 3 protrudes in part into said hole. The air supply hole 65 is connected to an air supply channel 66 in the motor housing 64. At the side of the air distributing means 61 which is oriented towards the rear rotor cover 31, three air distributing grooves 62 project radially outwards from the air supply hole 65 (see also FIG. 3), the grooves communicating with corresponding air inlets 10, 11, depending on the relative rotational position of the rear rotor cover 31 relative to the air distributing means 61.

Figure 2:
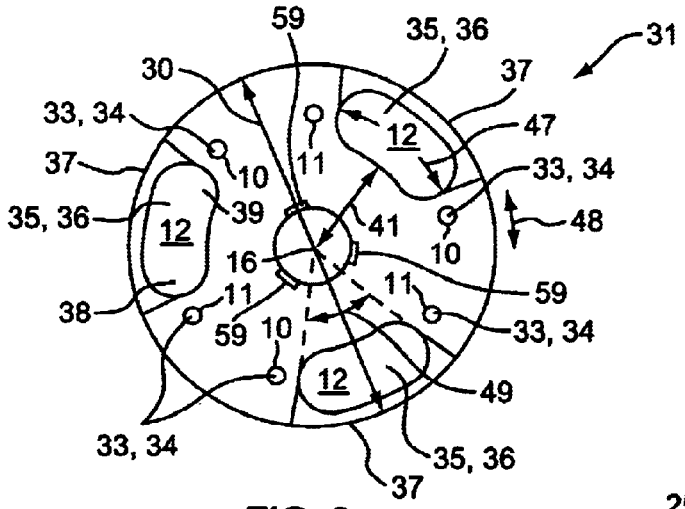
FIG. 2 is a top view on a rear rotor cover from the direction of a motor cylinder.

At its side facing the air distributing means 61, the rear rotor cover 31 comprises a recess which is arranged in concentric fashion relative to the rotational axis 16 and in which a ball bearing 56 is arranged for rotatably supporting the stub of the air rotor 3. Openings of compressed air recesses 59 which are formed in the side of the rear rotor cover 31 facing away from the air distributing means 61 terminate in the recess. A further embodiment of compressed air recesses 59 of that type is shown in FIG. 2.

By analogy with the rear rotor cover 31, the front rotor cover 32 is provided in its side facing away from the air rotor 3 with a recess which is concentrically arranged relative to the rotational axis 16 and in which a ball bearing 55 is also arranged. The output shaft 51 of the air rotor 3 extends through said bearing.

Rear and front rotor covers, motor cylinder with air rotor and air distributing means 61 are arranged in the motor housing 64 which is bipartite in the illustrated embodiment. A cup-shaped member 68 is provided in its bottom with the air supply channel 66, and a cover-like member 69 of the motor housing 64 can be screwed onto the free ends of said member 68.

The rear rotor cover 31 is connected to a switching knob 63 which is passed from the rear rotor cover radially outwards through the motor housing 64 and can be operated from the outside thereof. The switching knob 63 can be locked in two positions, one position of the rear rotor cover 31 corresponding to a left-hand rotation (see FIG. 5), and the other position to a right-hand rotation (see FIG. 7) of the air rotor 3.

For transmitting a reaction moment from the motor cylinder 2 to the front rotor cover 32, a pin 67 is arranged between said members. A corresponding means for transmitting the reaction moment from the front rotor cover 32 to the motor housing 64 is not shown for the sake of simplicity.

FIG. 2 is a view showing an inside of the rear rotor cover 31 from the direction of the motor cylinder 2 according to FIG. 1.

Various holes 34 are arranged as air inlets 33 in the rotor cover. A total of six holes 34 are provided, of which three drive an air rotor 3 (see FIG. 5) clockwise and anticlockwise, respectively, due to the supply of compressed air and upon a corresponding rotation of the front rotor cover 31 relative to the motor cylinder 2. Outlet recesses 36 are arranged as air outlets 35 between the holes 34. The outlet recesses 36 are partly of an annular shape and extend over a length 47 in circumferential direction 48 that corresponds to a mid-point angle 49. Radially to the outside, outlet recesses 35 communicate via outlet gap 37 (see also FIG. 1) with the surroundings of the air motor 1.

An inner radius 41 of the outlet recess 36 corresponds essentially to an outer radius 42 (see FIG. 5) of the air rotor 3. The diameter 30 of both the rear and front rotor cover 31, 32 is essentially equal to the diameter 29 of the motor cylinder 2.

Figure 3:
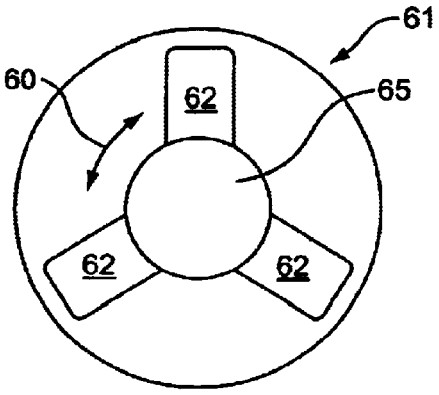
FIG. 3 is a view of an air distributing means from the direction of the rear rotor cover.

FIG. 3 is a front view showing the air distributing means 61 from the direction of the rear rotor cover 31 according to FIG. 1. The air supply hole 65 is arranged in concentric fashion relative to the rotational axis 16 and in the disk-shaped air distributing means 61, respectively. Three air-distributing grooves 62 extend from said hole in circumferential direction 60 at an equal distance, the grooves 62 being recessed in the visible surface of the air distributing means 61 according to FIG. 3 and laterally opened in the direction of air supply hole 65 (see also FIG. 1).

Figure 4:
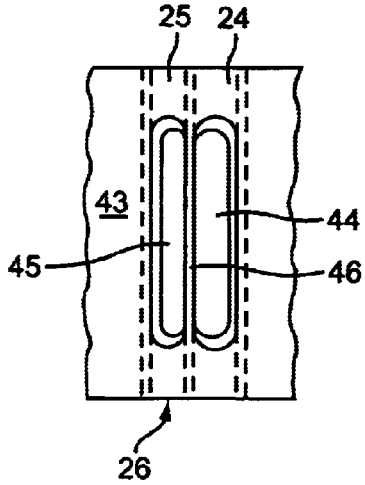
FIG. 4 is a view from the inside on a partly illustrated triangle side of an air rotor in the area of air inlet and air outlet channel.

FIG. 4 is a partial view from the inside on the motor cylinder 2 in the area of a channel body 26. An air inlet channel 24 and an air outlet channel 25 extend within the channel body over the total length thereof. Said channels are arranged in parallel with and spaced apart from each other in the channel body; see also FIGS. 5 and 6. On an inside 43 of the motor cylinder 2, the two channels 24, 25 are opened via slits 44, 45 towards air rotor 3; see also FIGS. 5 and 6. The slits 44, 45 extend approximately centrally relative to the channels 24, 25 over part of their length.

FIG. 5 is a section taken along line V—V of FIG. 1. Identical parts are provided with identical reference numerals and are only mentioned in part.

FIG. 5 shows, in particular, the substantially triangular cross-section of the motor cylinder 2, the triangle being an isosceles triangle with triangle sides 19, 20, 21 and corresponding triangle tips 13, 14 and 15; see also FIG. 6. The rotational axis 16 extends through a point of intersection 17 of mid-perpendiculars 18 of the triangle sides 19, 20, 21. In the area of the mid-perpendicular, see FIG. 6, the channel bodies 26 are arranged, each with an air inlet channel 24 and an air outlet channel 25, on outsides 23 of the triangle sides 19, 20, 21. The channel bodies are opened via their slits 44, 45 towards air rotor 3. A sealing web 46 with which the air rotor 3 is in tight contact is respectively arranged between the channels 24, 25.

A chamber 7, 8, 9 is formed between air rotor 3 and the corresponding triangle tips 13, 14,15, respectively. In the area of the triangle tips, an inner surface 22 of the motor cylinder 2 is convexly curved, and the corresponding curvatures have the same radius of curvature in the area of all triangle tips. In the area of the triangle sides 19, 20, 21, the inner surface 22 is convexly curved to a smaller degree, the curvature, in particular in the area of the sealing web 46, corresponding essentially to the corresponding curvature of the air rotor 3 on the outer circumference thereof.

In the illustrated relative position of rear rotor cover 31 to motor cylinder 2, an air inlet 10 (see FIG. 2) is in communication with a corresponding air inlet channel 24, whereas the remaining air inlets 11 (see FIG. 2 once again) terminate in chambers 7, 8, 9. The air outlet channels 25 are in communication with the outlet recesses 36 as corresponding air outlet 12; see FIG. 2. The outlet recesses 36 are here arranged with an end 38 in the area of the opening of the air outlet channel 25 and extend up to their other end 39 in the area of the corresponding chambers 7, 8, 9.

In the illustrated position of air inlets 10 relative to air inlet channel 24, the air rotor 3 is rotated counterclockwise 40 (left-hand rotation). When the rear rotor cover 31 is rotated by about 90° relative to the motor cylinder 2 until the air inlets 11 communicate with the air outlet channels 25, said air outlet channels serve as air inlet channels while the former air inlet channels 24 communicate with the outlet recesses 36 and serve as air outlet channels. In such a position of the rear rotor cover 31, the air rotor 3 is rotated clockwise (right-hand rotation), i.e. opposite to the rotational direction 40 shown in FIG. 5; see FIG. 7.

As follows from the above, a connection of the chambers 7, 8, 9 is established via the outlet recesses 36 with the outlet gaps 37 and thus with the surroundings of the air motor 1 for discharging compressed air contained in the chambers and supplied via air inlet channels 24.

As can in particular be seen in FIG. 5, the outer radius 42 of the air rotor 3 is substantially equal to the inner radius 41 (see FIG. 2) of the outlet recesses 36. Furthermore, the air rotor 3 comprises eight longitudinal slits 5 in which a corresponding number of lamellae 6 are guided in radial direction. Two neighboring lamellae 5 are each arranged relative to one another at an angle 50 which is smaller than the mid-point angle 49 assigned to the length 47 of the outlet recess 36; see FIG. 2.

Figure 7:
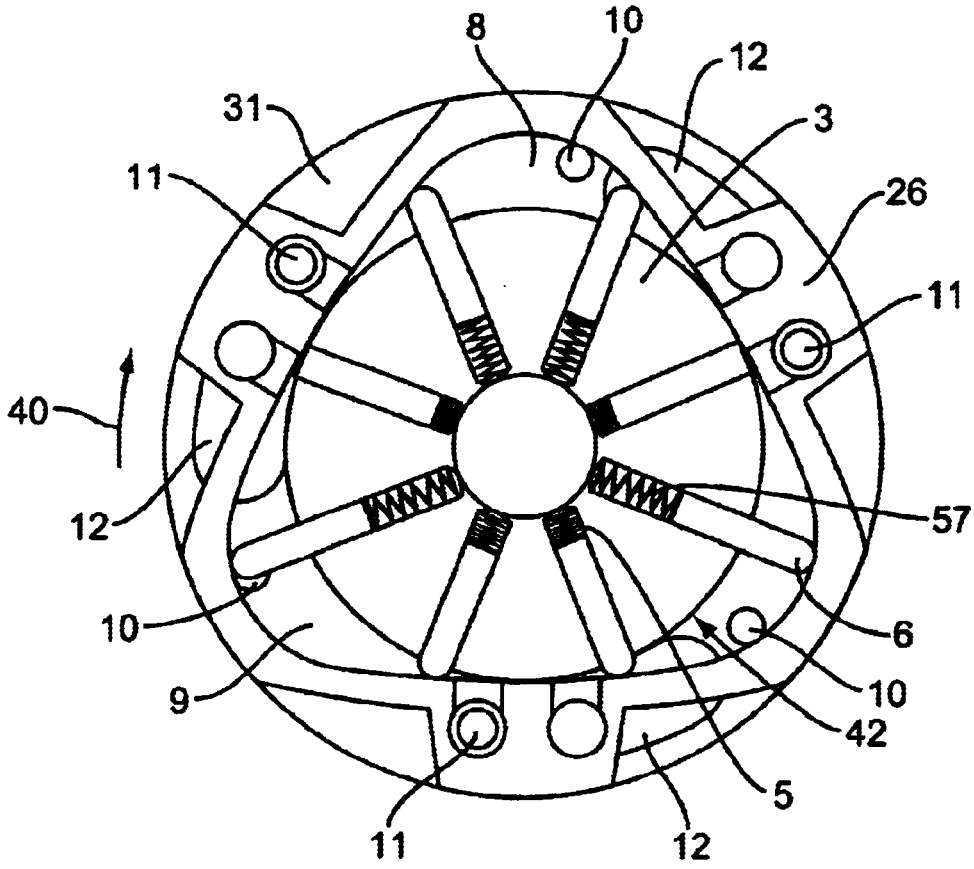
FIG. 7 is a section through FIG. 1 according to FIG. 5 for right-hand rotation.

Two diametrically opposed lamellae have arranged therein between a pressure spring 57 which acts on the lamellae in radial direction from the outside; see FIG. 7. The distance between two of said diametrically opposed lamellae remains relatively constant because of the inner contour of the motor cylinder 2, so that the spring lift is relatively small and the spring shows fatigue strength.

In FIG. 5, as an alternative to the pressure springs 57 according to FIG. 7, the rear rotor cover 31 is formed with the compressed air recesses 59 which, being partly radially inwardly offset with respect to the extended lamellae 6, are visible in the longitudinal slits 5. These serve the supply of compressed air into the slits and thus to extend the lamellae.

The three sealing lines between air rotor 3 and motor cylinder 2, see the corresponding sealing webs 46 separate supply air from exhaust air accordingly. Tangential leakage of air in the area between the air rotor and the motor cylinder should be as small as possible. A positional definition of the motor cylinder is taken over by the air rotor itself and an outer centering, e.g., in a housing, leads to an overdefinition of the installation position of the motor cylinder due to dimensional tolerances.

FIG. 6 shows a section, analogous to FIG. 5, only through the motor cylinder 2. Reference is made to the description in connection with the preceding figures.

FIG. 6 shows, in particular, how mid-perpendiculars 18 of the triangle sides 19, 20, 21 intersect at a point 17 corresponding to rotational axis 16. In particular in the area of the corresponding base points of the mid-perpendiculars 18, the triangle sides are convexly curved on the inside 22 of the motor cylinder 2, said curvature corresponding in particular in the area of the corresponding sealing webs 46 to the outer curvature of the air rotor 3.

The outer contour or outer surface 27 of the motor cylinder 2 extends in the area of the triangle tips 13, 14, 15 and the corresponding channel body 26 in curved fashion along a circular line 28 with diameter 29; see FIG. 1.

FIG. 7 shows a section, analogous to FIG. 5, for a right-hand rotation of the air rotor 3. Identical parts are provided with identical reference numerals, and reference is made to the description regarding FIG. 5.

FIG. 7 differs from FIG. 5 substantially only by the features that in the longitudinal slits 5 springs 57 are arranged for exerting pressure on the lamellae radially outwards, and that the rear rotor cover 31 s rotated by about 90° relative to the position according to FIG. 5 in clockwise direction.

The function of the three-chamber air motor 1 according to the invention shall now be explained in a few words with reference to the figures.

In the position according to FIG. 5, compressed air is supplied to the chambers 7, 8, 9 via air inlets 10 (see FIG. 2) and, accordingly, air inlet channels 24 with slits 44. Due to the compressed air acting on the lamellae 6 next to the air inlet channels 24, the air rotor 3 is rotated in rotational direction 40; see FIG. 5.

Upon rotation of the air rotor 3, a lamella trailing in the rotational direction finally comes into abutment with the slit 44 and, upon further rotation, is acted upon in rotational direction 40 by the compressed air supplied via the slit. The lamella arranged upstream in rotational direction 40 reaches outlet recess 36, so that compressed air contained in the corresponding chamber can escape behind said lamella 6 via the outlet recess and the corresponding outlet gap 37 radially to the outside from the air motor 1; see FIG. 1.

By analogy, the compressed air supply and compressed air discharge, respectively, takes place in the other channel bodies 26.

When the air inlets 11 (see FIG. 7) are brought into communication with the air outlet channels 25 by rotating the rear rotor cover 31 by about 90° relative to the motor cylinder 2, the air outlet channel becomes the air inlet channel and the former air inlet channel becomes the air outlet channel communicating with the corresponding outlet recess, the corresponding lamellae being acted upon by compressed air in a direction reverse to the former rotational direction 40 according to FIG. 5.

Thanks to the three-chamber air motor, there is a lower motor speed than in a two-chamber air motor, so that corresponding exhaust air throttling measures are no longer needed, in particular in screwers of the non-switching-off type. At the same time, the accelerating power is very uniform due to the three chambers and the corresponding number of lamellae, resulting in an increase in torque in comparison with the two-chamber air motor. Since the three-chamber air motor is also running evenly, an oil-free running is quite likely, resulting in an advantageous self-centering of the air rotor with reduced sound level.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. An air motor, comprising:

a motor cylinder having with three vertices and three sides and an inner chamber of a substantially triangular cross-section, each of said sides having a first air channel disposed generally adjacent a second air channel, said first and second air channels disposed in outward spaced relation from said inner chamber and extending longitudinally along said motor cylinder;

an air rotor rotatably supported in said motor cylinder and having a plurality of longitudinal slits extending in a longitudinal direction thereof, said longitudinal slits rad ally guiding moveable lamellae;

a plurality of drive chambers formed in said inner chamber between said air rotor and said motor cylinder between respective vertices of said motor cylinder, each of said drive chambers rotating into operative communication with an air inlet and hen into operative communication with an air outlet;

a front cover dispose on one end of said motor cylinder and a rear cover disposed on the opposing end of said motor cylinder;

wherein at least one o said front cover and said rear cover are rotatable relative to said motor cylinder to switch an incoming supply of air between said first air channel and said second air channels;

air outlet ports formed in at least one of said front cover and said rear cover, said air outlet ports selectively positionable to be in communication with either said first air channels or said second air channels; said air outlet ports comprising partially annular-shaped outlet recesses formed in the corresponding cover that open at least towards said motor cylinder.

2. The air motor of claim 1 wherein said outlet recesses open radially outward via an outlet gap.

3. The air motor of claim 1 wherein said inner chamber of said motor cylinder has an inner surface, wherein said first and second air channels connect to respective first and second openings on said inner surface that extend over a portion of the length thereof and open to said air rotor, said air rotor in tight contact with a sealing web separating said first and second openings.

4. The air motor of claim 1 wherein air rotor comprises at least seven longitudinal slits and corresponding number of said lamellae.

5. The air motor of claim 1 wherein said outlet recesses extend across a first angular distance, and adjacent said lamellae are spaced at a second angular distance larger than said first angular distance.

6. The air motor of claim 1 wherein at least two of said lamellae are disposed diametrically opposite one another, and further comprising a pressure spring disposed between said diametrically opposite lamellae.

7. The air motor of claim 1 wherein said outlet recesses curve at least partly annularly about a rotational axis of said air rotor.

8. The air motor of claim 1 wherein said inner chamber of said motor cylinder has a cross-section of an isosceles triangle having three mid-perpendiculars, and wherein said air rotor rotates about a rotational axis located at the intersection of said three mid-perpendiculars.

9. The air motor of claim 8 wherein respective sides of said inner chamber of said motor cylinder re convexly curved at least in the area proximate said mid-perpendiculars.

10. The air motor of claim 1 wherein an inner surface of said inner chamber is curved at least in the areas proximate said vertices.

11. The air motor of claim 10 wherein said inner surface of said inner chamber has an identical radius of curvature in the areas proximate said vertices.

12. The air motor of claim 1 wherein said motor cylinder comprises three channel bodies, and wherein each of said channel bodies has corresponding said first and second air channels formed therein.

13. The air motor of claim 12 wherein a circle having a first diameter touches an outer surface of said motor cylinder proximate said channel bodies and said vertices.

14. The air motor of claim 13 wherein said front cover has a second diameter and said rear cover has a third diameter; wherein said first diameter is less than at least one of said second and third diameters.

15. The air motor of claim 14 wherein said channel bodies extend between said front and rear covers.

16. The air motor of claim 1 wherein said rear cover is disposed upstream from said air rotor, said rear cover having air inlets formed therein supplying air to said first air channels or said second air channels.

17. The air motor of claim 16 wherein said air inlets in said rear cover comprise holes passing through aid rear cover.

18. The air motor of claim 17 wherein said holes are smaller in cross-sectional size than the corresponding air channels.

19. The air motor of claim 17 wherein at least one of said holes, said first channels, and said second channels are circular in cross-section.

20. The air motor of claim 16 wherein said rear cover is rotatable relative to said motor cylinder between a first position wherein said air inlets supply air to said first air channels and a second position wherein said air inlets supply air to said second air channels.

21. The air motor of claim 20 wherein said outlet recesses have an inner radius substantially equal to an outer radius of said air rotor.

22. The air motor of claim 1 wherein said outlet recesses have first and second ends and are sized and shaped such that one of said ends extends into one of said drive chambers between the corresponding channel body and vertex when said other end connects to one of said first and second air channels.

23. The air motor of claim 22 wherein said outlet recesses communicate with their respective drive chambers upstream of the respective first or second air channel acting as an outlet to the respective chamber.

24. The air motor of claim 1 further comprising a rear cover disposed on longitudinal end of said motor cylinder, said rear cover comprising a plurality of compressed-air recesses arranged around a center hole, said plurality of compressed-air recesses disposed concentrically about said center hole.

25. The air motor of claim 24 wherein said compressed-air recesses are disposed equidistant from one another.

26. The air motor of claim 24 wherein said air outlets in communication with said drive chambers pass through said rear cover.

27. The air motor of claim 24 wherein said rear cover has air inlets formed therein for supplying air to said first air channels or second air channels, and further comprising an air distributing means for supply of compressed air to said air inlets of said rear cover, said air distributing means disposed relative to said rear cover opposite said air rotor.

28. The air motor of claim 27 wherein said air distributing means is disk-shaped and comprises three air-distributing grooves facing said rear cover and extending radially outward from central air supply hole.

29. The air motor of claim 28 wherein said air distributing grooves are disposed equidistant from one another and correspond to different groups of said air inlets in communication with said drive chambers depending on the relative position of said air distributing means relative to said rear cover.

30. The air motor of claim 28 further comprising front cover disposed on an end of motor cylinder opposite said rear cover; further comprising a motor housing having arranged therein said front cover, said rear cover, said motor cylinder, said air rotor; said housing comprising an air supply channel communicating with said air supply hole of said air distributing means and a rotor hole which supports an output shaft of said air rotor.

31. The air motor of claim 30 wherein a pin is disposed between said front cover and said motor cylinder for transmitting a reaction moment.

32. The air motor of claim 24 wherein said rear cover is lockably supported in two positions relative to said motor cylinder, said rear cover positions corresponding to left-hand and right-hand rotation of the air rotor.

33. The air motor of claim 32 wherein said rear cover further comprises a radially outward protruding switching knob.

* * * * *